United States Patent [19]

Takamatsu et al.

[11] 4,383,493

[45] May 17, 1983

[54] ANCHOR

[75] Inventors: Osamu Takamatsu; Hiyoshi Ooshima; Katsuhiro Kaneko; Hiroyuki Hayashi; Toyomori Tsuda, all of Osaka, Japan

[73] Assignee: Hitachi Shipbuilding & Engineering Co., Osaka, Japan

[21] Appl. No.: 192,588

[22] Filed: Sep. 30, 1980

[30] Foreign Application Priority Data

Oct. 3, 1979 [JP] Japan ..... 54-128154
Oct. 3, 1979 [JP] Japan ..... 54-128155
Mar. 26, 1980 [JP] Japan ..... 55-40823[U]

[51] Int. Cl.[3] ..... B63B 21/26

[52] U.S. Cl. ..... 114/294; 114/295; 114/300

[58] Field of Search ..... 114/294, 295, 296, 300

[56] References Cited

U.S. PATENT DOCUMENTS 588,767 8/1897 Hoyt ..... 114/300
3,799,098 3/1974 Taylor et al. ..... 114/294

FOREIGN PATENT DOCUMENTS 690594 6/1965 Italy .
119348 10/1918 United Kingdom ..... 114/294
594287 11/1947 United Kingdom ..... 114/294
1293521 10/1972 United Kingdom ..... 114/296

*Primary Examiner*—Sherman D. Basinger
*Attorney, Agent, or Firm*—Millen & White

[57] ABSTRACT

An anchor includes an approximately frustoconical main body having a small height, and a chain attaching shank is located at the center of the main body and is rotatable about a substantially vertical axis.

7 Claims, 5 Drawing Figures

ANCHOR

BACKGROUND OF THE INVENTION

The present invention relates to an anchor, and more particularly, to an anchor used chiefly for mooring large-sized structures floating on the sea, such as floating piers, buoys, floating breakwaters, offshore platforms, oil storage vessels, etc.

Floating offshore structures of such a large size are frequently held onto the sea bottom with anchors, which must possess a great holding power for retaining the floating structure against winds, waves and currents. The heavier, the anchor, the greater the holding power. However, anchors of increased weight are costly and difficult to handle. Further with elongated large offshore structures, it is also common practice to hold one end only of the structure with a single anchor in order to permit the structure to shift to a direction such that the external forces acting, for example, the force winds, waves and currents acting on the structure will always be minimized, even when the direction of the force changes. However, conventional anchors are adapted to afford a great holding power by digging into sludge, mud, sand and like deposits (hereinafter referred to collectively as "sand") on the bottom of the sea only when they are pulled in a specific direction, so that, if the conventional anchors are pulled in a different direction, the anchor becomes dislodged from the sand, then shifts in direction while moving toward the direction of the pull and thereafter lodges in the sand. Thus every time the floating structure shifts in direction, the conventional anchor also shifts, failing to hold the structure in a specified location. It is therefore desirable to provide an anchor having a great holding power against a pull or drag in every direction.

SUMMARY OF THE INVENTION

An object of this invention is to provide an anchor having a great holding power against a pull in any direction.

Another object of the invention is to provide a lightweight anchor.

Still another object of the invention is to provide an anchor which is simple in construction and inexpensive to make.

These objects can be fulfilled by an anchor including an approximately frustoconical main body having a small height, with a chain attaching shank provided at the center of the main body which is capable of rotation about a substantially vertical axis.

DESCRIPTION OF THE PREFERRED EMBODIMENTS

Figure 1:
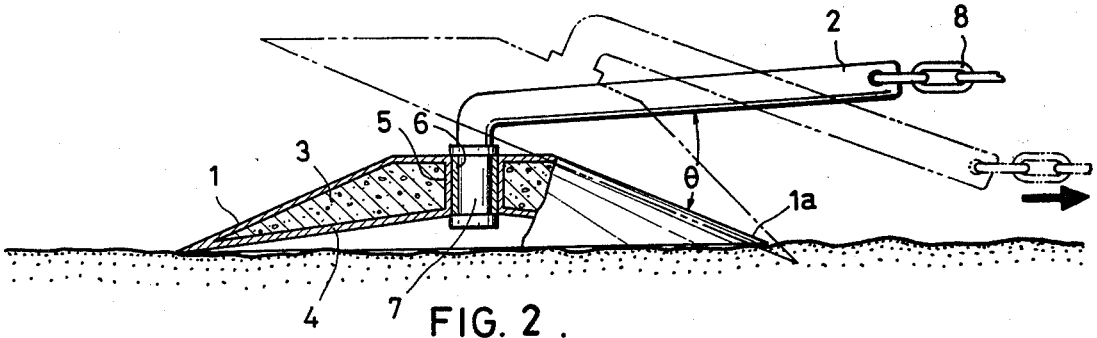
FIG. 1 is a front view partly broken away and showing a first embodiment of the invention.

FIG. 1 shows a first embodiment of the invention.

With reference to FIG. 1, an anchor includes an approximately frustoconical main body 1 having small height and a chain attaching shank 2 located at the center of the main body 1. The main body 1 is made up of a steel plate and has a hollow interior filled with concrete 3. Thus, the main body 1 is of a hybrid structure. The main body 1 has a bottom plate 4 which slants downward and outwardly from the center portion. Useful materials for filling the interior of the main body 1 are those which are inexpensive and have a relatively large specific gravity, such as concrete, sand, rocks, slags, etc. The main body 1 has suitable reinforcing steel members (not shown) in the hollow interior. The main body 1 has a cylindrically shaped inner plate 5 at its center which defines a vertically extending bore which has a bearing 6 located therein. The chain attaching shank 2 is L-shaped and has at its one end a short rod portion 7 which is rotatably fitted in the bearing 6 on the main body 1. The shank 2 extends outwardly at an angle from a center upper portion of the main body 1 beyond the outer periphery thereof and has a distal end to which a mooring chain 8 is attached.

The anchor is normally cast into the sea and installed on the bottom as seen in FIG. 1. In whatever direction the anchor may be pulled, the shank 2 turns in the direction of the pull, causing the outer peripheral portion 1*a* of the main body 1, immediately below the shank 2, to dig into the sand on the bottom and become lodged therein, so that a great holding power can be obtained. Since the main body 1 shaped like a truncated cone having small height with the bottom plate 4 slanting downward and outwardly from its center, the main body 1 digs into the sand in a smooth fashion. In this case, the main body 1 can pivot about the digging peripheral portion 1*a* into an inclined position as shown by the broken line in FIG. 1, however, the contact of the distal end of the shank 2 with the bottom restrains the inclination, preventing the main body 1 from turning over. Additionally, the inclination of the main body 1 enables the main body to bite into the sand at the digging peripheral portion 1*a* more effectively. In fact, when conventional anchors of having a high holding power and anchors of the first embodiment having a weight equal to that of the former were tested for holding characteristics by being dragged on seashore sand placed on the bottom of an experimental water tank, the anchors of the first embodiment were found to have an exceedingly greater holding power than the conventional anchors. Accordingly the anchor of the first embodiment, even when having a considerably reduced weight, can give a holding power which is comparable to that of the conventional ones. While the test was conducted with use of several anchors according to the first embodiment and having varying angles $\theta$ of 15 to 30 degrees between the main body 1 and the chain attaching shank 1, the test results revealed that the holding power increases with a decrease in the angle $\theta$. In practice, an optimum angle $\theta$ may be determined in accordance with the shape of the anchor, quality of the sand on the bottom of the sea, etc. When the main body 1 is pulled in a different direction with the peripheral portion 1*a* digging into the sand as described above, the shank 2 turns toward the direction of the pull, causing the main body 1 to gradually incline toward the shank 2 with this movement. At the same time, the portion of the main body outer periphery 1*a* digging into the sand gradually shifts from the initial position to below the shank 2. Eventually the anchor almost comes to a halt without moving further laterally and lodges in the sand in the same manner as has already been described. As will become apparent from FIG. 1, the anchor has a very simple construction, and is inexpensive to make since the interior of the main body 1 is filled with a material, such as concrete, which is inexpensive and has a great specific gravity to give an increased weight to the anchor.

Figure 2:
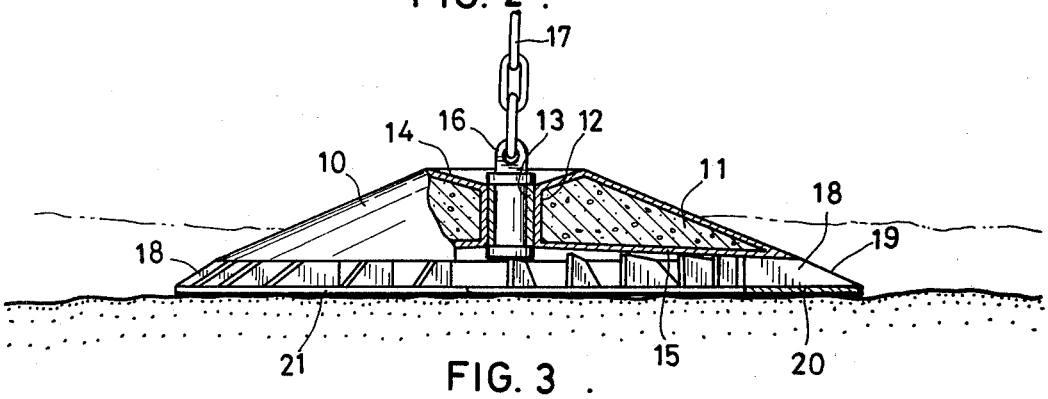
FIG. 2 is a front view partly broken away and showing a second embodiment of the invention.
Figure 3:
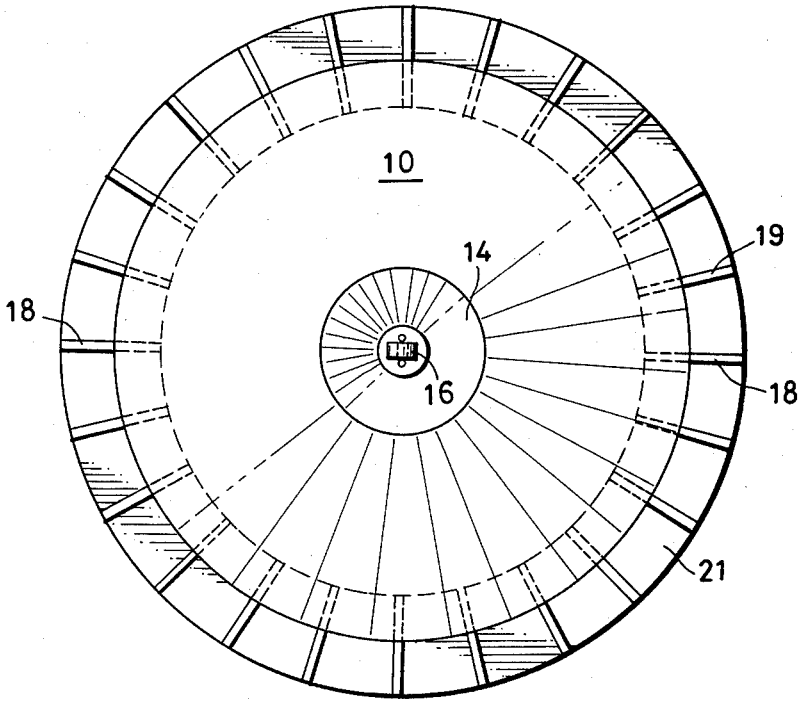
FIG. 3 is a top plan view corresponding to the embodiment of FIG. 2.

FIGS. 2 and 3 show a second embodiment of the invention.

Like the first embodiment, the anchor main body 10 shown in FIGS. 2 and 3 has a hybrid structure which is made of a steel plate, which is hollow, approximately frustoconical and is filled with concrete 11 throughout the interior. The main body 10 has, at its center, a vertically extending and cylindrically shaped inner plate 12 which has a bearing 13 positioned therein. The main body 10 has at its center portion a top plate 14 which slightly slants inwardly downward. Further, a bottom plate 15 slants slightly downward and outwardly from the center portion. A chain attaching shank 16 is shaped like a short straight rod and is rotatably retained and fitted within the bearing 13. A mooring chain 17 is then attached to the upper end of the shank 16. A multiplicity of equally spaced vanes 18 are arranged radially along the outer periphery of the bottom of the main body 10. Each of the vanes 18 is in the form of a trapezoidal shaped steel plate having a sharp outer end. The vanes 18 are disposed vertically and joined to the bottom plate 15 in a position that the edge 19 of each vane slanting outwardly downward extends outward from the outer periphery of the main body 10, with the bottom edge 20 positioned to extend horizontally. The vanes 18 are joined, at their bottom edges 20, to the upper side of a horizontal annular reinforcing steel plate 21.

Preferably, the anchor is installed in place so that at least the lower portion of the main body 10 is embedded in the sand on the bottom of the sea as shown by the broken line of FIG. 2. When so installed, the anchor will have extremely high resistance to the force acting thereon in any direction due to winds, waves or currents, and thus affords a great holding power. However, the anchor may be placed merely on the sand on the bottom as shown by the solid line in FIG. 2. Whatever direction the anchor may be pulled even in this case, the vanes 18 which are located in the direction of the pull dig into the sand and lodge therein, similarly giving a great holding power. At this time, the spaces between the vanes 18 beneath the bottom of the main body 10 serve as passages for the sand to permit the anchor to dig into the sand with greater ease.

The number and shape of the vanes 18 are not limited to those illustrated but are suitably variable. The reinforcing steel plate 21 for the vanes 18 need not always be provided.

Furthermore, the anchor main body and the main chain attaching shank are not limited, in construction, shape, etc., to those of the foregoing two embodiments but can be modified suitably.

Figure 4:
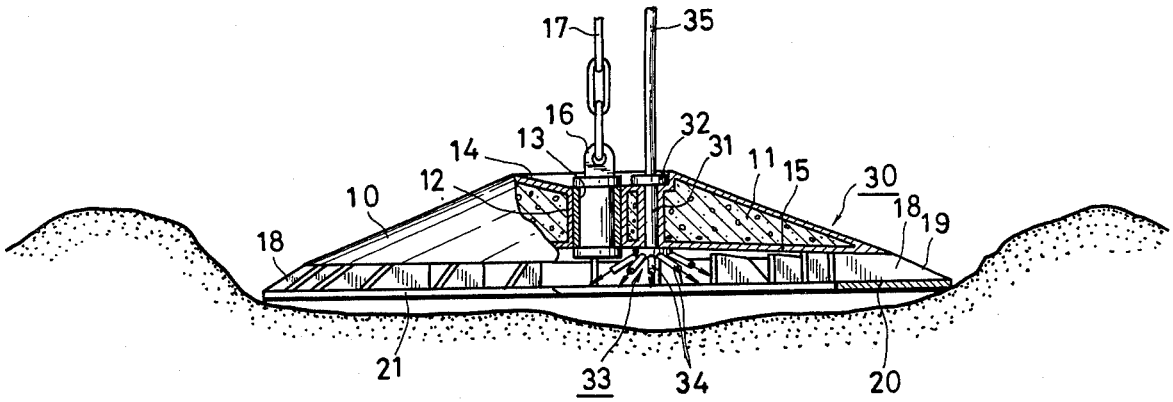
FIG. 4 is a front view partly broken away, showing a fourth embodiment.
Figure 5:
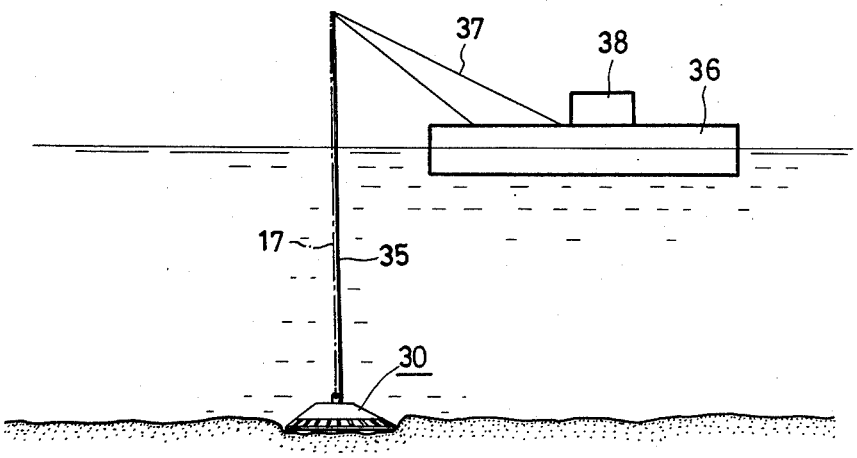
FIG. 5 is a schematic front view illustrating how to install the anchor of FIG. 4 on the bottom of the sea.

FIGS. 4 and 5 show a third embodiment of this invention.

The parts shown in FIG. 4 which are the same as those shown in FIG. 2 are referred to by the same reference numerals and will not be described. Preferably, in close proximity to the center of the main body 10 of an anchor 30, but at some distance from the chain attaching shank 16, a bore vertically extends through the main body 10 to provide a seawater channel 31. The channel 31 has an upper end having a hose attaching portion 32 and a lower end fixedly provided with a seawater jetting device 33. The jetting device 33 has a multiplicity of nozzle tubes 34 which are arranged radially and inclined slightly downward.

Like the second embodiment, the anchor 30 provides a great holding power when placed merely on the sand on the bottom. The anchor nevertheless gives a still great holding power if it is installed so that at least the lower portion of the main body 10 is embedded in the sand on the bottom by the following method.

The method of installing the anchor 30 will be described with reference to FIGS. 4 and 5.

A flexible hose 35 for supplying seawater is connected at its one end to the hose attaching portion 32 of the anchor 30, and a chain 17 is attached at its one end to the shank 16. The chain 17 attached to the anchor 30 is suspended from a crane 37 on a work ship 36 floating on the sea. The other end of the hose 35 is connected to a seawater pump 38 on the ship 36.

The chain 17 is paid off to lower the anchor 30. Upon reaching the bottom of the sea, the anchor 30 is stopped temporarily. Alternatively the anchor 30 may be held suspended at a position some distance above the bottom.

With the anchor 30 thus held on, or close to, the bottom, seawater is supplied from the pump 38 to the jetting device 33 through the hose 35 to force out the water radially from the nozzle tubes 34. The jets of water move the sand from under the anchor 30 and outwardly to form an accumulation around the anchor 30 (see FIG. 4).

As the sand is removed from under the anchor 30, the chain 17 is progressively paid off to further lower the anchor 30. In this way, the anchor 30 is brought down into the sand while removing the underlying portion of sand with the jets of seawater. After the anchor 30 has been placed at a predetermined depth and settled, the discharge of seawater is discontinued, and the hose 35 is removed from the anchor 30 by a diver or remote control. The jetting device 33 may be left on the anchor 30. Thus the anchor 30 is installed in place. Although the anchor 30 is merely surrounded by a large accumulation of sand but no sand is present on the anchor 30 immediately after installation as will be apparent from the above description, the surrounding portion of sand covers the anchor 30 owing to the flow of seawater near the bottom when the anchor 30 is thereafter allowed to stand. Consequently the anchor 30 becomes embedded in the sand.

The seawater jetting device can be of any desired construction provided that it is capable of jetting out seawater in a radial direction. For example, the device can include a horizontal extender rotary member attached to the lower end of the seawater channel 31, and a plurality of nozzle tubes extending from the outer periphery of the rotary member at a tangent thereto for jetting out seawater while being caused to revolve in a horizontal plane as a result of the reaction of the jets of water.

What is claimed is:

1. An anchor comprising:

a main body having an approximately frustoconical shape, the height of said shape being smaller than the diameter of the outer periphery thereof, said main body further comprising an opening extending vertically therethrough at the center thereof;

shank means rotatably mounted within said opening;

the bottom outer periphery of said main body having a continuous circular shape; and a plurality of vanes, each shaped as a vertically extending plate, arranged spaced apart along the outer periphery of the main body and the tops of the vanes attached to the bottom of the main body, with a horizontally extending annular plate attached to each of said vanes at the bottom edge thereof and spaced below the main body, whereby said arrangement of said vanes and said annular plate function to dig into the bottom and lodge therein in response to a pull exerted on said anchor from any direction.

2. An anchor according to claim 1 wherein said main body has a bottom slanting downward outwardly from the center portion thereof.

3. An anchor as defined in claim 1 wherein said main body is made of steel plate and has a hollow interior filled with a material having a great specific gravity.

4. An anchor as defined in claim 3 wherein said main body has a bottom slanting downward outwardly from its center portion.

5. An anchor according to claim 1 further comprising jetting means operatively associated with said main body for selectively forcing a fluid radially outwardly from the bottom of said main body to move bottom material outwardly from under the anchor to cause said material to form an accumulation around said anchor as said anchor settles at a predetermined depth, whereby said accumulated material then covers said anchor as a result of the natural flows of the surrounding medium.

6. An anchor according to claim 5 wherein said jetting means comprises a plurality of nozzles positioned attached to the bottom of said main body at a position around the center thereof, said nozzles being connectible to a fluid supply, and arranged so as to force fluid radially outwardly therefrom.

7. An anchor according to claim 6 wherein said fluid supply comprises a hose connectible to said nozzles for supplying pumped seawater from the floating body to the nozzles, said hose leading from a floating body to which said anchor is attached.

* * * * *